US005394984A

United States Patent [19]

Aiba

[11] Patent Number: 5,394,984

[45] Date of Patent: Mar. 7, 1995

[54] HOLDER FOR HEXAGONAL WRENCHES

[76] Inventor: Tateshi Aiba, 1691-5, Kanekoshinden, Sanjyo-shi, Niigata-ken, 955, Japan

[21] Appl. No.: 199,913

[22] Filed: Feb. 22, 1994

[30] Foreign Application Priority Data

Apr. 2, 1993 [JP] Japan ..... 5-016436 U

[51] Int. Cl.[6] ..... B65D 85/28

[52] U.S. Cl. ..... 206/377; 211/69; 211/70.6; 206/372; 206/379

[58] Field of Search ..... 206/377, 379, 372; 211/70.6, 69; 81/177.1, 177.4

[56] References Cited

U.S. PATENT DOCUMENTS

| | | | |
|---|---|---|---|
| D. 48,166 | 11/1915 | Bennett | 211/69 |
| 2,604,211 | 7/1952 | Steine | 211/69 |
| 2,633,768 | 4/1953 | Saxby | 206/377 |
| 2,715,028 | 8/1955 | Dossie | 81/177.4 |
| 2,786,380 | 3/1957 | Rolland | 206/377 |
| 2,810,472 | 10/1957 | Midkiff | 206/377 |
| 3,727,771 | 4/1973 | Hoffman | 211/69 |
| 3,997,053 | 12/1976 | Bondhus | 206/377 |

*Primary Examiner*—David T. Fidei
*Attorney, Agent, or Firm*—Quarles & Brady

[57] ABSTRACT

Disclosed is a holder for hexagonal wrenches which can compactly house a plurality of hexagonal wrenches therein and also be used as a grip for hexagonal wrenches. Around the outer peripheral surface of the holder body 1 is formed a corrugated portion 4 to provide a gripping portion 5. Said holder body 1 is formed with fitting holes 6, corresponding to each size of hexagonal wrenches 2. Then, into the fitting holes 6 are inserted the shafts 2A of the hexagonal wrenches 2 in order to incorporate the hexagonal wrenches 2 in the holder body 1. According to the structure of the invention, a plurality of hexagonal wrenches 2 of different sizes can be compactly housed in the holder body 1. Further, the hexagonal wrenches 2 are nearly integrated with the holder body 1, which are able to be utilized as a grip for hexagonal wrenches 2.

4 Claims, 4 Drawing Sheets

HOLDER FOR HEXAGONAL WRENCHES

BACKGROUND OF THE INVENTION (a) Field of the Invention

The present invention relates to a holder for hexagonal wrenches provided for housing a plurality of hexagonal wrenches of different diameters therein.

(b) Description of Prior Art

In general, as hexagonal wrenches are provided as a set of a plurality of hexagonal wrenches of different diameters, there are some fear that some of them will be missing in the event that they are separately kept.

To solve the above problem, there is provided an arranging tool in Japanese Utility Model Laid-Open No.3-82176, wherein at the center of a base is mounted a horizontally rotatable tabular housing plate by a supporting shaft, said housing plate being formed with through-holes corresponding to each diameter of each hexagonal wrench, being spaced by a predetermined distance. And then, inserting said hexagonal wrenches into the through-holes, thereby hooking each operating portion at the distal ends of said hexagonal wrenches to said housing plate so as to enable the batch housing of a plurality of said hexagonal wrenches.

Whereas, as the above-mentioned arranging tool is provided with the base and the housing plate rotatably mounted thereabove, it is inevitably to become a large type, necessitating a relatively wide space to keep it, which is incovenient to carry it about. Furthermore, the smaller the diameters of hexagonal wrenches of this kind become, the less their lengths will become in general, so that the gripping shafts or handles thereof will become shorter and the diameters smaller. As a result, such an arranging tool has a problem such that it is difficult to operate or revolve the hexagonal wrenches.

SUMMARY OF THE INVENTION

Accordingly, it is the main object of the present invention to provide a holder for hexagonal wrenches which can compactly house or accomodate a plurality of hexagonal wrenches.

It is another object of the present invention to provide a holder for hexagonal wrenches of which the holder portion can be also utilized for a gripping portion for the hexagonal wrenches.

In accordance with a major feature of the present invention, there is provided a structure of a holder for hexagonal wrenches comprising:

- a holder body whose peripheral surface is formed with a gripping portion;
- a plurality of fitting holes provided along the longitudinal length of said holder body, corresponding to each diameter of said hexagonal wrenches, which are fitted into said fitting holes in order to incorporate the hexagonal wrenches in said holder body.

BRIEF DESCRIPTION OF THE DRAWINGS

Other objects, features and advantages of the invention will be apparent to those skilled in the art from the following description of the preferred embodiment of the invention, wherein reference is made to the accompanying drawings, of which.

DESCRIPTION OF A PREFERRED EMBODIMENT

Figure 1:
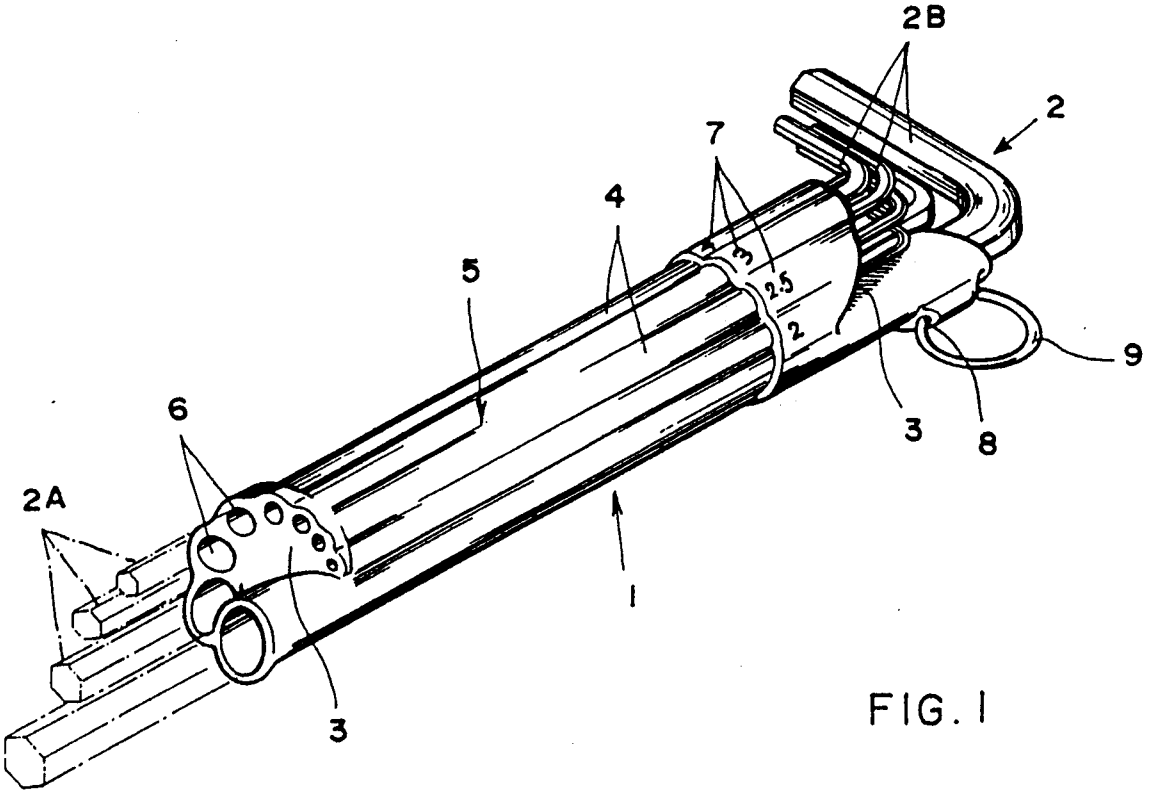
FIG.1 is a perspective view of an embodiment of a holder for hexagonal wrenches of the present invention.

Hereinafter is described a first embodiment of the present invention with reference to FIGS. 1 to 5, in which the referece numeral 1 designates a holder body made of synthetic resin provided for housing hexagonal wrenches therein. Said holder body is formed approximately cylindrical, having helically -sloped surfaces 3 at its both ends, which are formed symmetrical each other. Around the outer peripheral surface of the holder body 1 is formed corrugated portion 4 which is positioned in parallel with the longitudinal length of said holder body 1, thereby forming a gripping portion 5.

The hexagonal wrenches 2 incorporated in said holder body 1 are conventional wrenches which are bent so as to be of letter "L" configuration comprising relatively long shafts 2A having hexagonal sections and relatively short operating portions 2B, while said hexagonal wrenches 2 are provided as a set of a plurality of hexagonal wrenches of different diameters.

Said holder body 1 for housing said plurality of hexagonal wrenches 2 by incorporating them therein is formed with fitting holes 6, corresponding to the number of said hexagonal wrenches 2, said fitting holes 6 being spaced by a predetermined distance approximately in the same circular arc. Each diameter of said fitting holes 6 is so formed that each inner surface thereof will abut on each corner of said shaft 2A of said hexagonal wrenches 2, corresponding to each diameter thereof, as shown in FIG.3.

Incidentally, the reference numeral 7 designates display portions formed by printing or the like on an outer surface of said holder body 1, indicating a each size of said hexagonal wrenches 2, while the reference numeral 8 designates a mounting hole for a ring 9 provided for hanging said holder body 1.

With the structure thus made, said shafts 2A of the hexagonal wrenches 2 are fitted into said fitting holes 6, corresponding respectively thereto, thereby housing a plurality of hexagonal wrenches 2 of different sizes in said holder body 1, with the operating portions 2B of the hexagonal wrenches 2 being protruding from said helically-sloped surfaces 3 provided at the both ends of said holder body 1.

Figure 2:
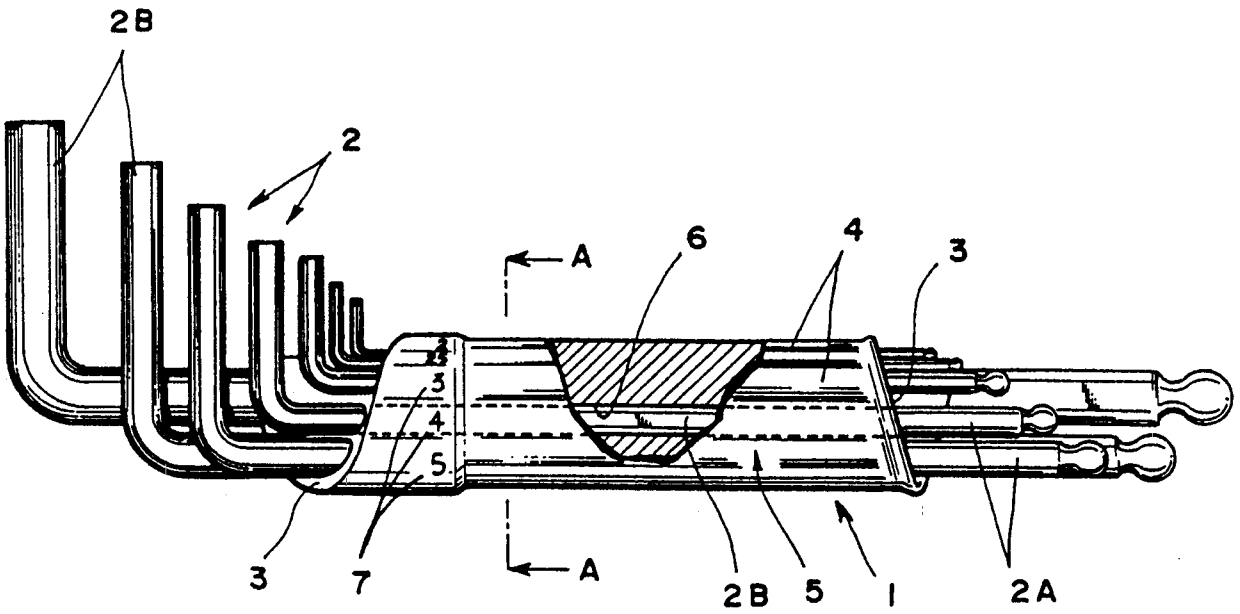
FIG.2 is a front view of a holder for hexagonal wrenches of the invention, of which the holder body are partially cut away.
Figure 3:
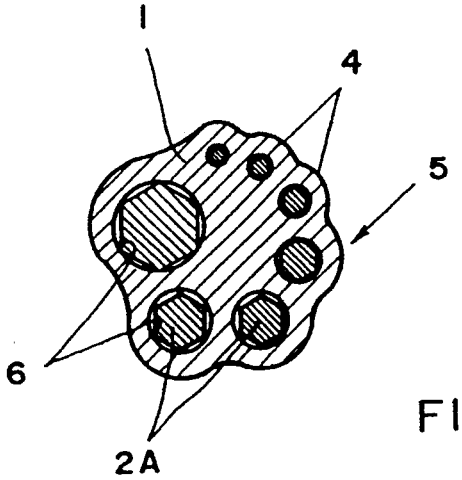
FIG.3 is a section on line A-A of FIG.2.

Further, as can be seen from FIGS. 2 and 3, as said helically-sloped surfaces 3 are provided at both ends of said holder body 1, each operating portion 2A of said hexagonal wrenches 2 outwardly protruding from said holder body 1 are disposed in a stepped state along said helically-sloped surface 3, whereby said hexagonal wrenches 2 can be efficiently accomodated into said holder body 1. In addition, as said fitting holes 6 are formed in approximately the same circular arc, said operating portions 2B, which are protruding from said helically-sloped surfaces 3, only slightly overlap one another, so that the interference of one operating portion 2B with another can be minimized.

Therefore, for example, in the event that an operating portion 2B of a hexagonal wrench 2 positioned relatively outside interferes with the most inside hexagonal wrench 2 in pulling the same out of said holder body 1, only a slight displacement of said operating portion 2B by shifting said outside hexagonal wrench 2 toward either the left or right direction can allow said most inside hexagonal wrench 2 to be easily taken out.

Accordingly, when a user takes out a hexagonal wrench 2 fitted inside said holder body 1, he can be free from such a nuisance that he must take out an inside hexagonal wrench 2 after he pulls out all the hindering hexagonal wrenches positioned relatively outside. Consequently, the user can easily take out only the inside hexagonal wrench 2.

Figure 4:
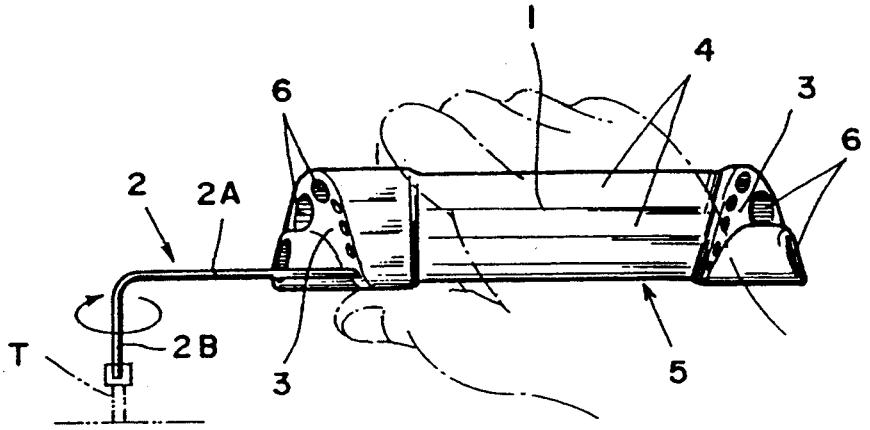
FIG.4 is a front view illustrating one of the operating portions of the hexagonal wrenches is in use.
Figure 5:
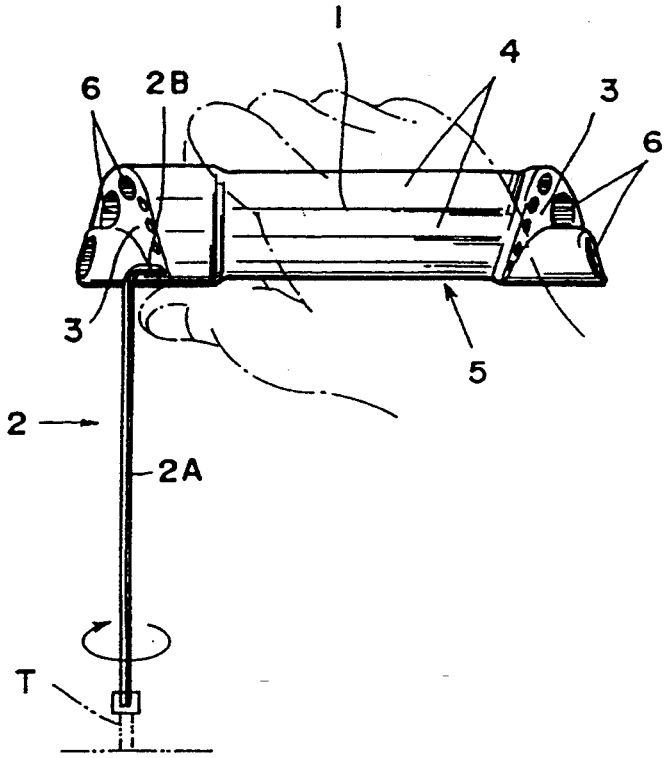
FIG.5 is a front view illustrating one of the shafts of the hexagonal wrenches is in use.

Furthermore, as shown in FIGS. 4 and 5, said holder body 1 and hexagonal wrenches 2 are nearly integrated, with said hexagonal wrenches 2 being fitted into said holder body 1, thus said holder body 1 can be also utilized as a grip for said hexagonal wrenches 2. Therefore, said hexagonal wrenches 2 will become easy to grip in using the same owing to said thick holder body 1 having a gripping portion 5, so that it will become easier to screw a nut or a bolt by means of said hexagonal wrenches 2. As shown in FIG.5, especially in using the shafts 2A of said hexagonal wrenches 2, the operating portions 2B, which are difficult to grip because of the short lengths thereof, are fitted into said fitting holes 6 of the holder body 1, thereby enabling the easy revolving of said hexagonal wrenches 2. This is especially advantageous in using said shafts 2A of said hexagonal wrenches of small sizes.

As hereinabove described, in accordance with the invention, a plurality of hexagonal wrenches 2 of different sizes are fitted into said fitting holes 6 of the holder body 1 in order to integrally incorporate the same in said holder body 1, whereby a plurality of hexagonal wrenches 2 can be compactly housed without a fear of losing them, which is convenient enough to carry about. Further, the both ends of said holder body 1 are formed with the helically-sloped surfaces 3, while the fitting holes 6 are formed on approximately the same circular arc, being spaced by a predetermined distance, whereby the obstraction or the interference of one operating portion 2B with another can be minimized, consequently, only a desirable hexagonal wrench 2 can be easily taken out in pulling out a hexagonal wrench 2 from said holder body 1. Moreover, as said holder body 1 can be utilized both as a holder and a grip, a hexagonal wrench 2 of a small size can be more easily revolved, which is advantageous in using the same.

Incidentally, the present invention should not be limited to the embodiments thus far described, but can be modified within the scope of the invention. For example, a configuration or material of said holder body should not be limited to those shown in the embodiments, but may be suitably chosen. And the number of said hexagonal wrenches fitted into the holder body may be also optionally chosen.

What is claimed:

1. A holder for a plurality of hexagonal wrenches (2) of different sizes comprising:

a holder body (1) having a gripping portion (5) around the peripheral surface thereof;

a plurality of fitting holes (6) provided along the longitudinal length of said holder body (1), corresponding to each diameter of said hexagonal wrenches (2), said each hexagonal wrench (2) being fitted into said each fitting hole (6) corresponding thereto, wherein said holder body (1) is formed with helically-sloped portions (3) at both ends thereof, said helically-sloped portions (3) being formed symmetrical to each other.

2. A holder for a plurality of hexagonal wrenches of different sizes according to claim 1, wherein said holder body (1) are formed with a corrugated portion (4) along its longitudinal length around the outer peripheral surface thereof.

3. A holder for a plurality of hexagonal wrenches of different sizes according to claim 1, wherein said fitting holes (6) are formed in approximately the same circular arc, said each fitting hole (6) being spaced by a predetermined distance.

4. A holder for a plurality of hexagonal wrenches of different sizes according to claim 1, which is characterized in that:

said holder body (1) is capable of being used both as a holder and a grip.

* * * * *